US005680845A

United States Patent [19]

Peng

[11] Patent Number: 5,680,845

[45] Date of Patent: Oct. 28, 1997

[54] ALIGNMENT DEVICE OF DUAL-SPRAY INJECTORS FOR INTERNAL COMBUSTION ENGINE

[75] Inventor: Li-Chung Peng, Taipei Hsien, Taiwan

[73] Assignee: Industrial Technology Research Institute, Hsinchu, Taiwan

[21] Appl. No.: 708,260

[22] Filed: Sep. 6, 1996

[51] Int. Cl.[6] ..... F02M 55/02

[52] U.S. Cl. ..... 123/470

[58] Field of Search ..... 123/456, 468, 123/469, 470, 472

[56] References Cited

U.S. PATENT DOCUMENTS

| | | | |
|---|---|---|---|
| 4,727,843 | 3/1988 | Petersen et al. | 123/470 |
| 5,040,512 | 8/1991 | Twilton | 123/470 |
| 5,044,340 | 9/1991 | Robnett | 123/470 |
| 5,074,269 | 12/1991 | Herbon et al. | 123/470 |
| 5,329,905 | 7/1994 | Kawaguchi et al. | 123/470 |
| 5,520,151 | 5/1996 | Gras et al. | 123/470 |

*Primary Examiner*—Thomas N. Moulis
*Attorney, Agent, or Firm*—Bacon & Thomas

[57] ABSTRACT

An alignment device of dual-spray injectors for internal combustion engine includes at least one link with two or more retaining openings engegable with the injector nozzles such that the injector will be prevented from axial rotation. The upper portion of the injector is housed in a cup with a first O-ring located inside and set against an injector seat collar above the cylinder head. The retaining opening on the link further has an elastic padding disposed thereon. The injector is thus prevented from axial movement. Therefore fuel can be precisely ejected into the gas intake duct for complete combustion and resulting in more output power and reduced exhaust pollution.

4 Claims, 8 Drawing Sheets

ALIGNMENT DEVICE OF DUAL-SPRAY INJECTORS FOR INTERNAL COMBUSTION ENGINE

BACKGROUND OF THE INVENTION

1. Field of the Invention

This invention relates to an alignment device for dual-spray injectors used in internal combustion engine with the purpose of limiting the axial displacement and rotation of dual-spray injectors.

2. Description of the Prior Art

The design and structure of internal combustion engine nowadays focus mainly on multiple valves, high power, low fuel consumption, completed combustion and low pollution. As a result, the fuel system of an internal combustion engine has evolved from conventional single point injection to multiple points injection now. Such a change can improve combustion efficiency and thus increase output power. It requires an injector to equip with two fuel outlets for fuel to enter two gas inlet ducts to mix with air. The combination of multiple valves and dual spray injector need very precise structure and positioning to attain the desired results. Therefore the alignment of duel-spray injectors become very critical. Referring to FIGS. 7 and 8, when a fuel injector is wrongly positioned, even slightly, such as a small deviation axially or angularly, fuel will be fallen on the wall of the gas inlet. It will result in not sufficient fuel entering into the cylinder, and thus producing less power. The combustion also will be not completed and producing air pollution. In order to resolve this problem, there is a need to align the dual-spray injectors properly. FIGS. 1 and 2 show what has been commonly used in a conventional internal combustion engine. There is an injector seating collar 2*a* located on a lateral side of a gas intake duct 11*a* of a cylinder head 1*a* for holding a dual-spray injector 3*a*.

At the injector nozzle 31*a*, there is mounted a second O-ring 4*b*. A cup 51*a* houses the upper potion of the injector 3*a*. At the injector inlet end 32*a*, there is mounted a first O-ring 4*a* which is securely held in the cup 51*a* which in turn is fluidity communicating with a fuel duct 5*a*. The first and second O-ring 4*a* and 4*b* can prevent the injector 3*a* from moving axially. On a lateral side of the fuel duct 5*a*, there is a stopper 6*a* contacted firmly with a circuit terminal ease 33*a* to prevent the injector 3*a* from turning axially. The structure like this has the following disadvantages:

1. The O-rings 4*a* and 4*b* cannot prevent the injector 3*a* from turning axially. When subject to external force, the injector 3*a* tends to fit and causing fuel falling on the wall of the gas inlet duct, and thus resulting n in loss power and not complete combustion.
2. There is no dust guarding means on the injector seating collar 2*a*. When the second O-ring 4*b* needs repair or replacement after long time of use, dust tends to enter into the gas intake duct 11*a* and the combustion chamber 12*a*. This will cause not complete combustion and excessive wear of the components.
3. The structure and assembly of the injector 3*a*, fuel duct 5*a*, cup 51*a*, stopper 6*a* and circuit terminal case 33*a* are complicated and time-consuming.
4. The stopper 6*a* needs special material and production process to make, and thus will increase the cost.

SUMMARY OF THE INVENTION

In view of the aforesaid disadvantages, it is therefore an object of this invention to provide an allurement device of dual-spray injector for internal combustion engine that can effectively resolve the problem of axial movement and turning of the injector, and can also be easily produced and maintained.

It is another object of this invention to provide an alignment device of dual-spray injector which is versatile and can be easily adopted to the fuel duct made of different materials.

It is a further object of this invention to provide an alignment device of dual-spray injector which not only can prevent the injector from axial movement but also can prevent dust from entering into the intake duct and combustion chamber.

In order to achieve the aforesaid objections, this invention uses a linkage means engaging and interlocking a plural number of injectors. Therefore the axial movement of the injectors can be effectively harnessed. The linkage means can also be easily adopted to different types fuel duct.

This invention further has a retaining collar to hold a first O-ring tightly, and a rubber padding on the linkage means for preventing the injector from axial movement, and for dust-guarding.

Additional advantages of the present invention will be made apparent in the following description having reference to the accompanying drawings. The drawings are only to serve for reference and illustration purpose, and do not intend to limit the scope of the present invention.

DETAILED DESCRIPTION OF THE PREFERRED EMBODIMENT

Figure 1:
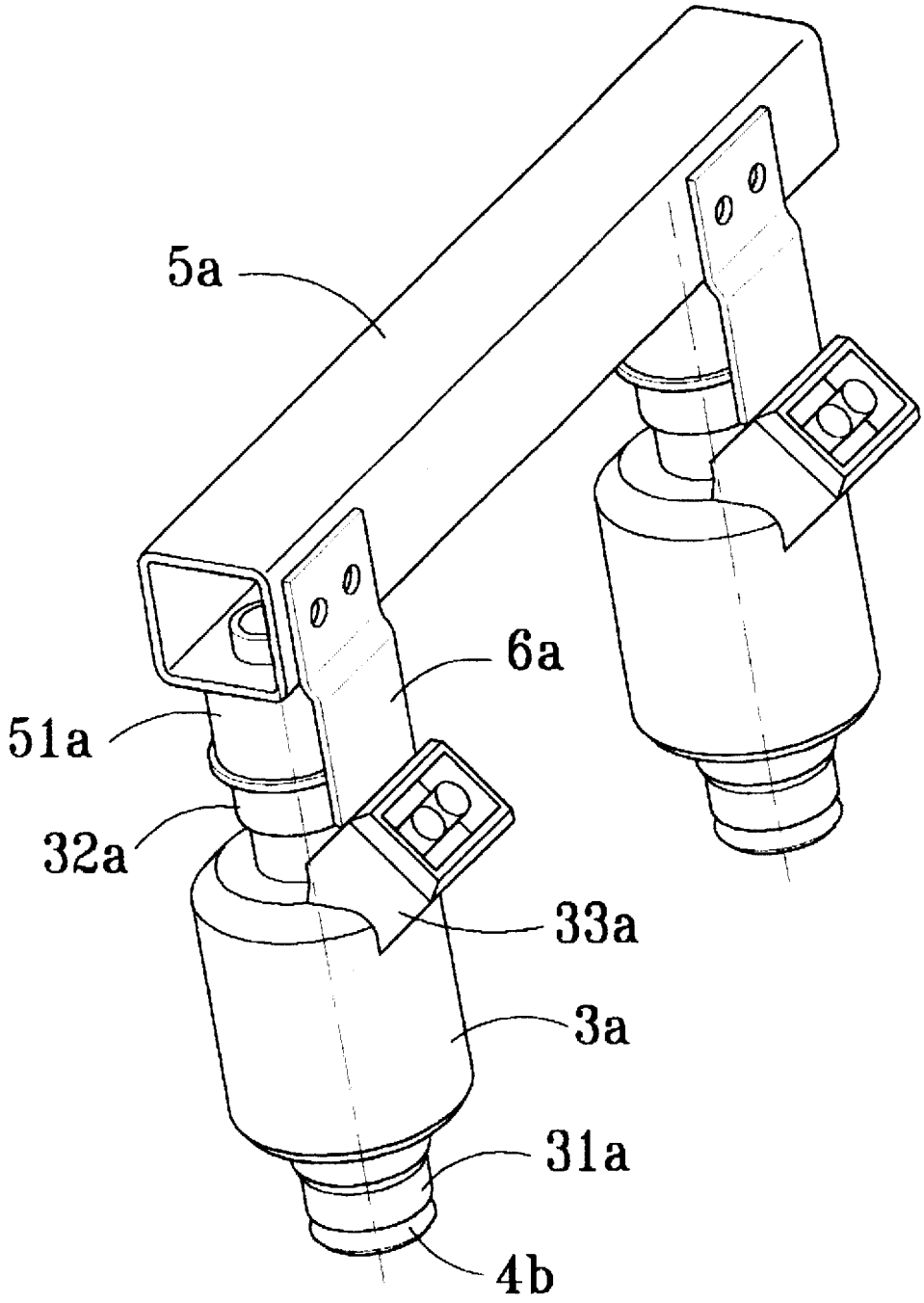
FIG. 1 is a perspective view of a conventional dual-spray injector and fuel duct.
Figure 2:
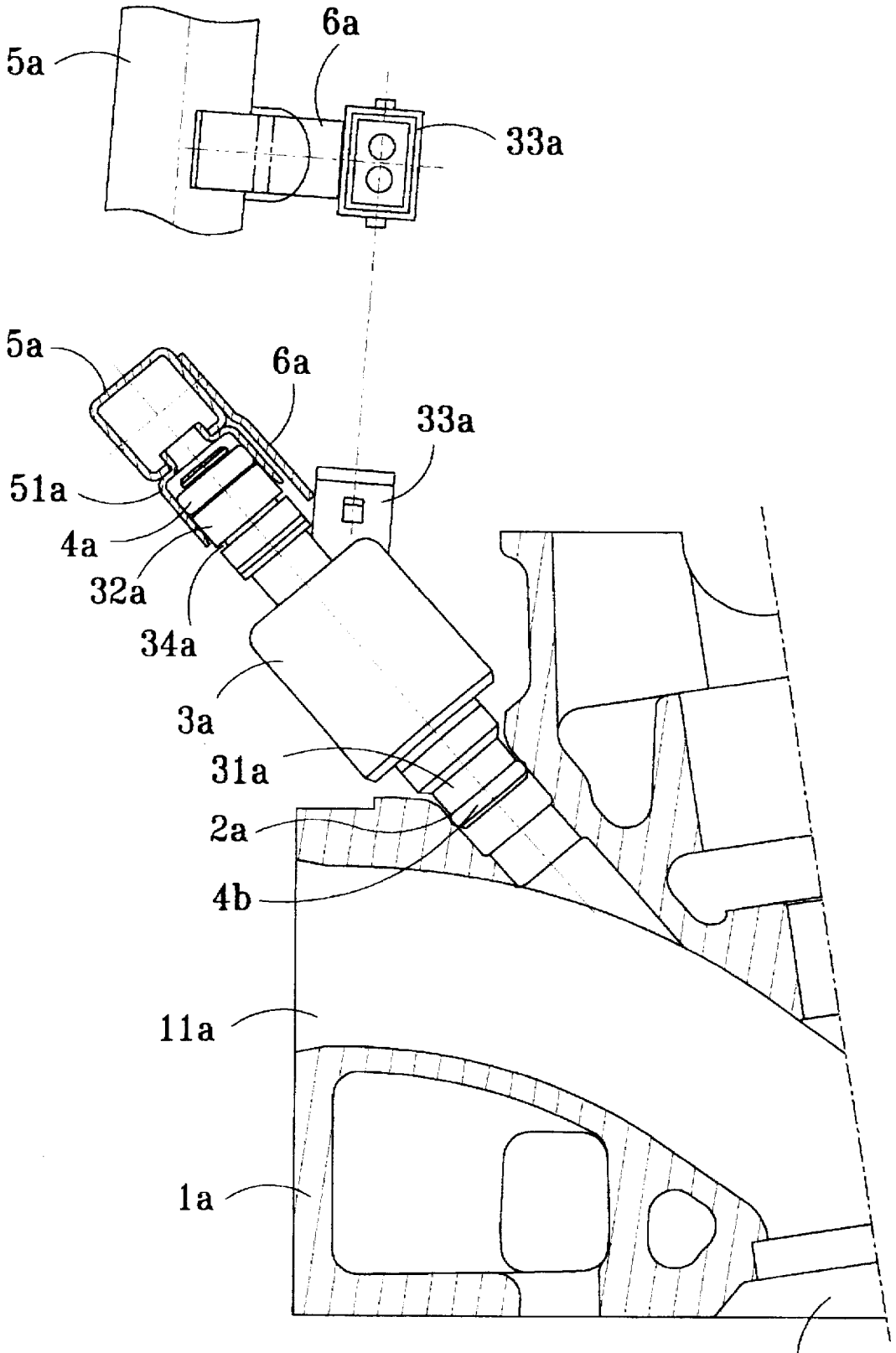
FIG. 2 is a side sectional view and fragmentary top view of a conventional dual-spray injector, fuel duct and a cylinder head.
Figure 3:
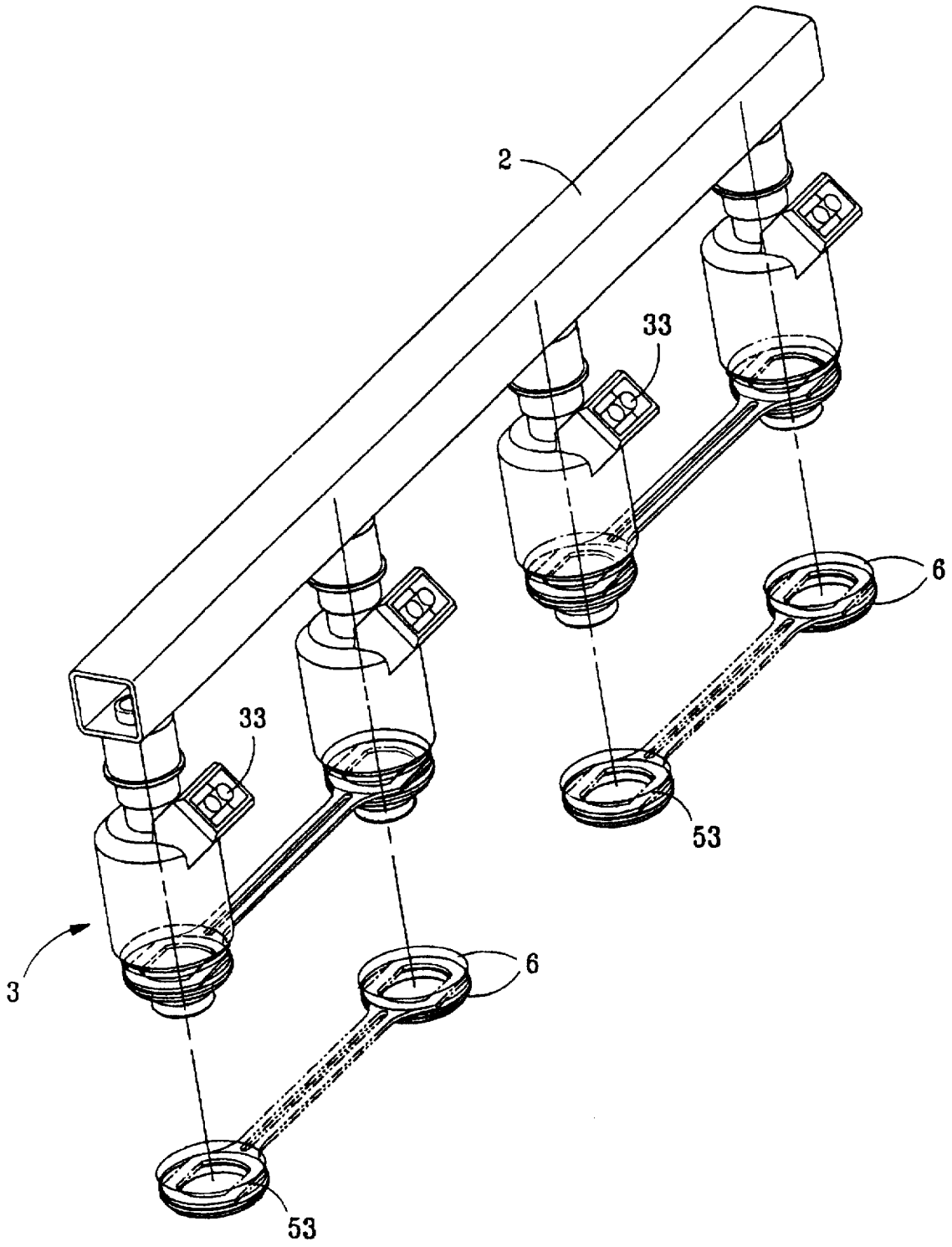
FIG. 3 is a perspective view of an embodiment of this invention.
Figure 4:
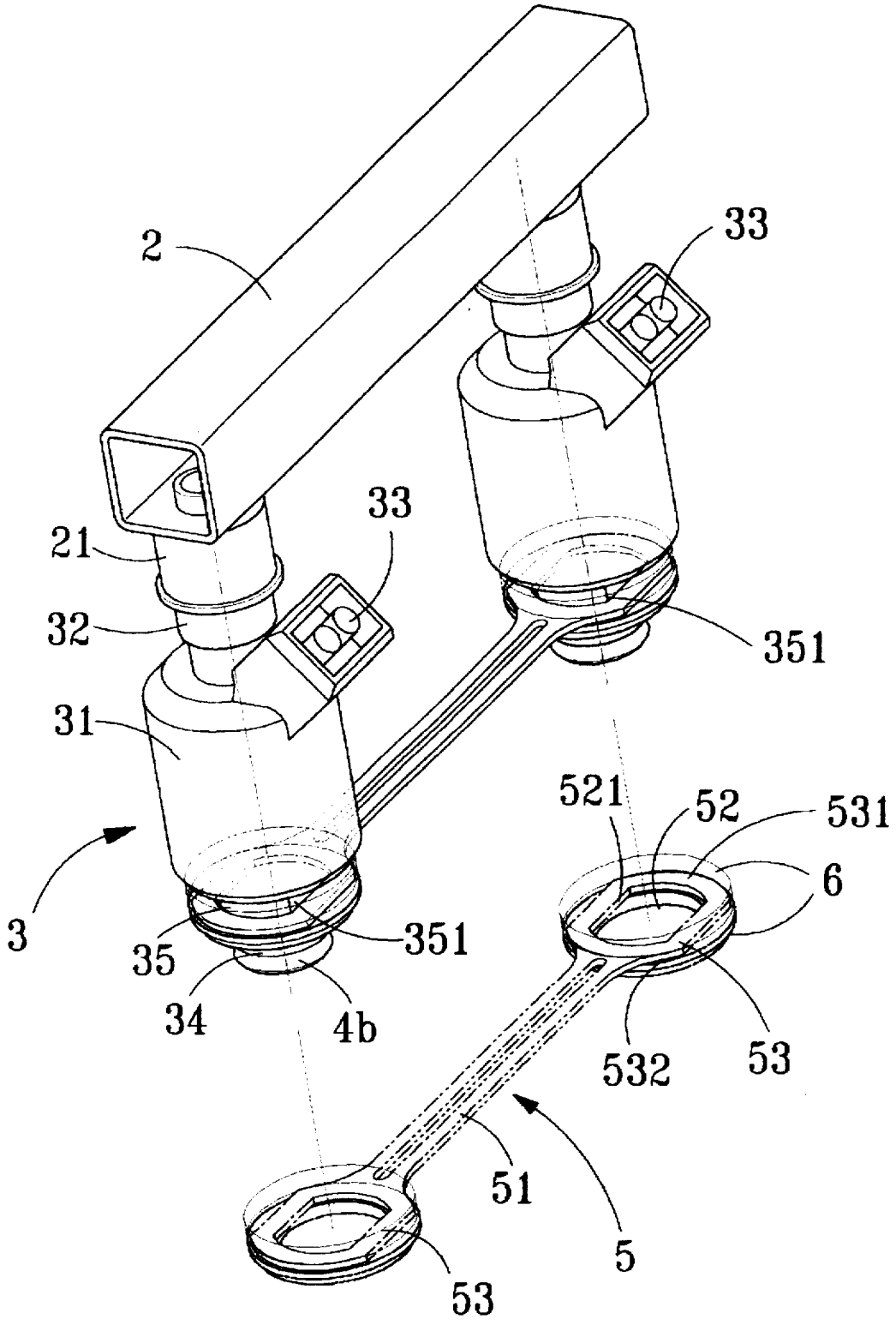
FIG. 4 is a fragmentary perspective view of this invention.
Figure 5:
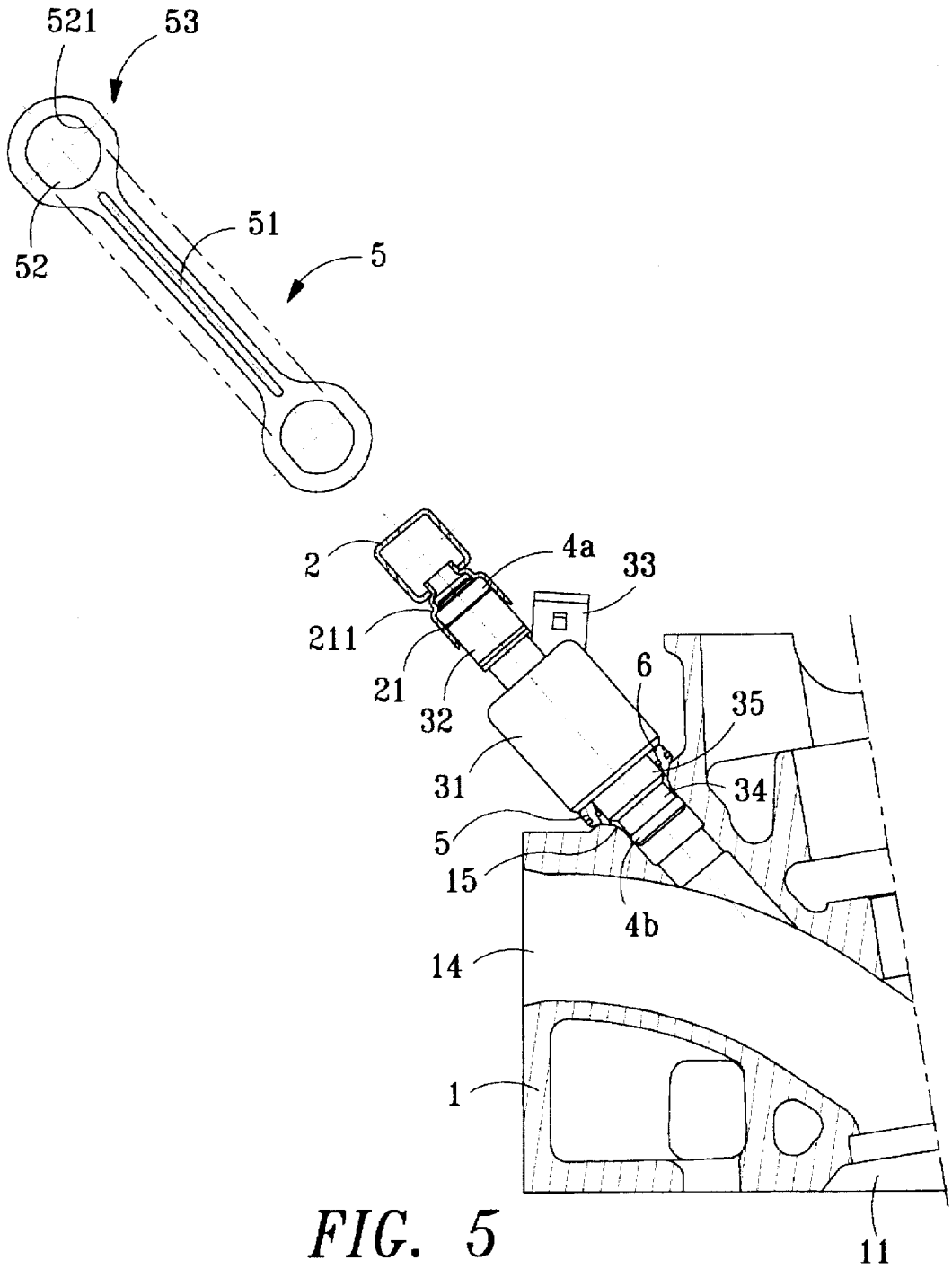
FIG. 5 is a fragmentary section view of this invention.
Figure 6:
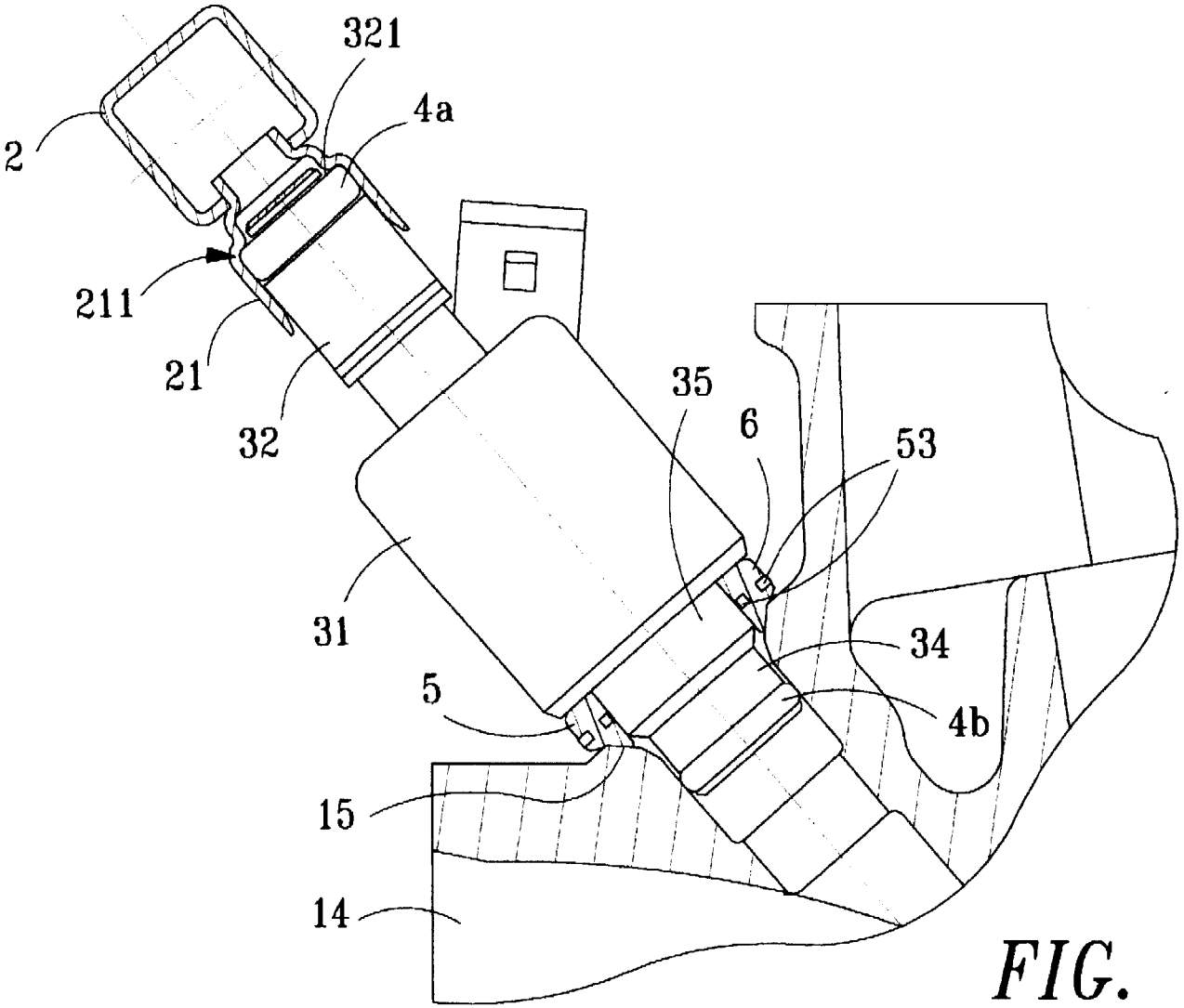
FIG. 6 is another fragmentary section view of this invention.

FIGS. 3, 4, and 5 show an embodiment of this invention. In a cylinder head 1, there is a combustion chamber 11 which has a valve seat 12 with an intake valve 13 located therein (also shown in FIGS. 6 and 7).

A gas intake duct 14 is fluidly communicating with the valve seat 12. At inside surface of the gas intake duct 14, there is an injector seat collar 15 upon which an injector 3 is located. The injector 3 has a cylindrical body 31 with a fuel intake section 32 at an upper portion. The fuel intake section 32 is housed in a cup 21 which has a retaining ring 211 at an upper portion. The cup 21 is fluidly communicating with a fuel duct 2. A first O-ring 4*a* is set within the cup 21 between the fuel intake section 32 and the retaining ring 211.

Under the injector body 31 is a second cylindrical body 35 which has two parallel retaining edges 351 on both sides.

Below the second cylindrical body 35 is an injector nozzle 43 which has a second O-ring 4b located thereunder. The injector nozzle 34 has at least two nozzle openings formed therein (not shown in the figures). A circuit terminal 33 is located between the injector body 31 and the fuel intake section 32. A flat link 5 has two or more rings 53 each with a retaining opening 52 formed therein. A pair of rings 53 is connected by a link shank 51. Each retaining opening 52 has two parallel retaining rims 521. There are two washers located on the two lateral sides 531 and 532 of the ring 53. Each ring 53 further has at least one elastic padding 6 set thereon. The elastic padding is preferably made of oil-resistant rubber. The retaining opening 52 engages with an injector nozzle 34 with the retaining ring 521 held against the retaining edges 351. There fore the injector 3 can be prevented from axial turning.

The first and second O-rings 4a and 4b are firmly engaged respectively with the retaining collar 211 and the injector seat collar 15, so that the injector 3 cannot be moved axially. The elastic padding 6 sealed over the injector seat collar 15 can prevent dust form entering into the intake duct 14 and cylinder 11.

Figure 7:
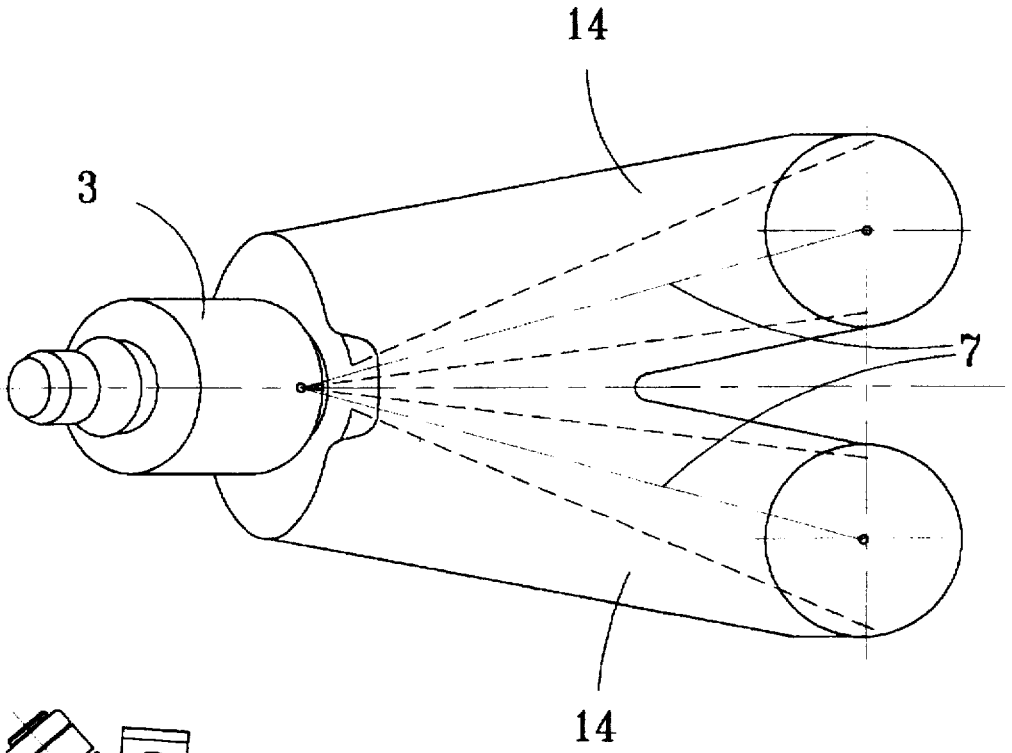
FIG. 7 is a schematic top view of a dual-spray injector and dual gas intake duct.
Figure 8:
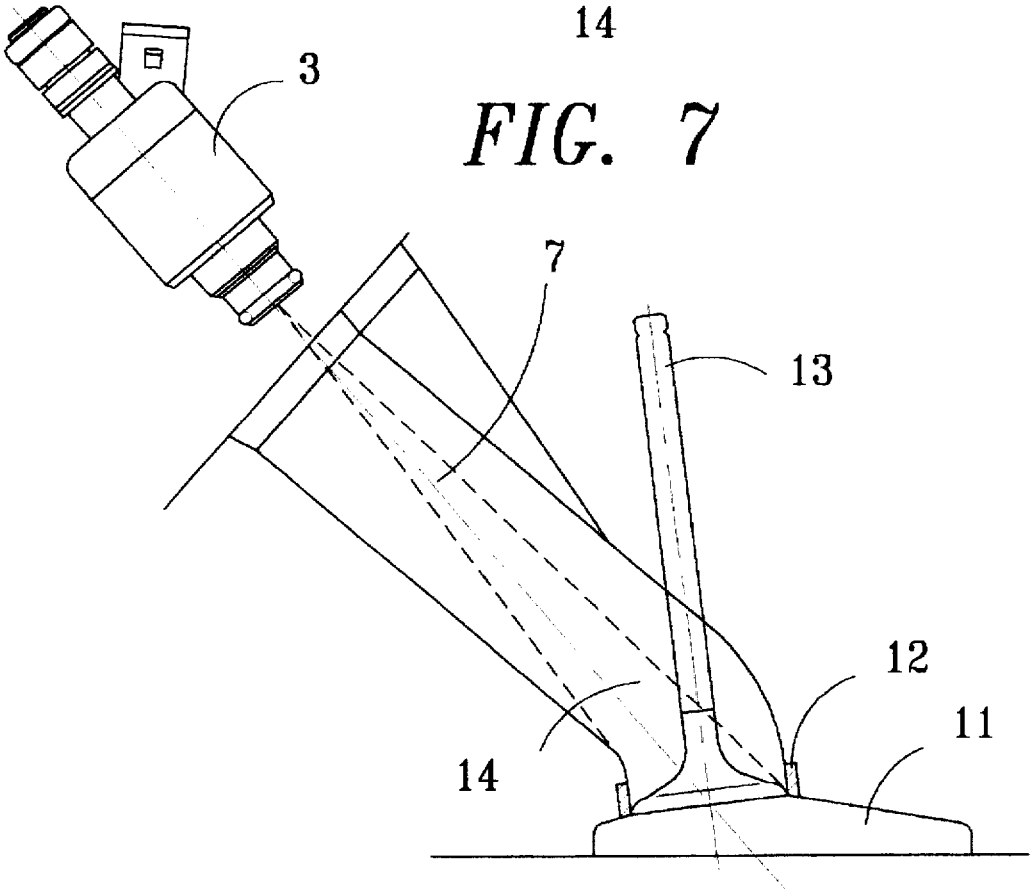
FIG. 8 is a side view of a dual-spray injector, a dual gas intake duct and a valve.

FIGS. 7 and 8 show this invention in use. A dual-spray injector 3 is set for a gas dual-intake duct 14 each has a valve seat 12 located at one end thereof. When the valve 12 opens, a fuel stream 7 is ejected from the injector 3, passing through the fork like intake duct 14 and entering into the combustion chamber 11 for ignition and combustion. This invention can offer the following advantages;

1. The first and second O-ring 4a and 4b offer the first level means to harness the axial displacement of the injector 3. The retaining collar 211 and the injector seat collar 15 offer the second level means to further prevent the injector 3 from moving axially. The retaining opening 52 and retaining rims 521 of the link 5 can securely engage with the retaining edge 351 of the injector 3, and thus can effectively prevent the injector 3 from turning axially. Therefore once the injector 3 is properly positioned, the fuel ejection can be accurately control which will result in complete combustion. Consequently more engine power output can be obtained and exhaust gas pollution can be reduced.
2. The rubber padding 6 on the link 5 can effectively prevent dust from entering into the intake duct 14 and combustion chamber 11. Therefore can extend the service life of the components.
3. The link 5 can align two or more injectors 3 correctly and quickly with the fuel duct 2 and the valve seat 12. The component number needed is reduced. The material and assembly costs also become lower.
4. The link 5 can effectively replace conventional stopper for preventing the injector 3 from turning. Moreover the link 5 can be made from a wide range of materials, and can further reduce the cost.

Figure 9:
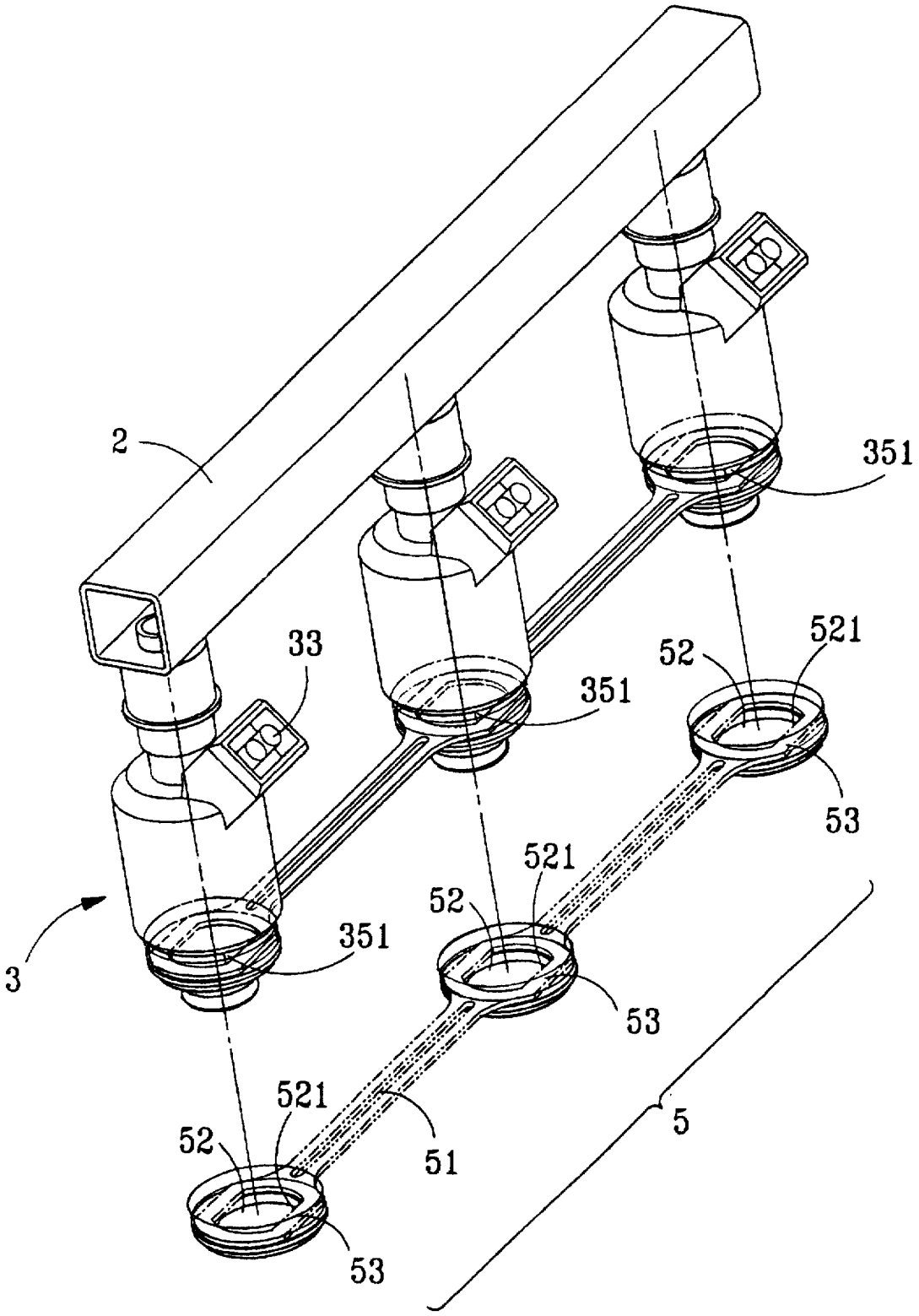
FIG. 9 is a perspective view of another embodiment of this invention.

Besides the embodiment disclosed above, this invention may be presented in a number of variations. For instance, a link 5 may engage three injectors 3 (as shown in FIG. 9). The retaining edge 351 and the matching retaining rim 521 may be one side, two sides or in key-slot shape. The elastic padding 6 may be separately made or integrally formed on the link 5.

Accordingly, the appended claims are intended to cover all embodiments which do not depart from the spirit and scope of the invention.

What is claimed is:

1. An alignment device of dual-spray injectors for internal combustion engine, comprising;

a plural number hollow cups fluidly communicating with a fuel duct;

a plural number of cylindrical injectors each having at least two nozzles, each nozzle having at least one retaining edge and a second O-ring located thereon; the injector further having a first O-ring located at an upper portion which is housed in the cup, and a circuit terminal slantly located on an fuel inlet portion; and a flat link including at least two retaining openings each having at least one retaining rim for engaging with the retaing edge of the injector, wherein the injector is prevented from turning because of the flat link.

2. The alignment device of dual-spray injectors according to claim 1, wherein each retaining opening has at least two washers located therein and an elastic padding for contacting with an injector seat collar such that the injector is prevented from moving axially.

3. The alignment device of dual-spray injector according to claim 2, wherein the elastic padding has at least one retaining rim formed therein.

4. The alignment device of dual-spray injector according to claim 2, wherein the elastic padding is made of rubber.

* * * * *